US005734352A

United States Patent [19]

Seward et al.

[11] Patent Number: 5,734,352

[45] Date of Patent: Mar. 31, 1998

[54] MULTIBAND ANTENNA SYSTEM

[75] Inventors: Glen J. Seward, Cincinnati, Ohio; Paul E. Miller, Spring Lake, Mich.

[73] Assignee: R. A. Miller Industries, Inc., Grand Haven, Mich.

[21] Appl. No.: 615,607

[22] Filed: Mar. 13, 1996

Related U.S. Application Data

[63] Continuation-in-part of Ser. No. 452,079, May 26, 1995, abandoned, which is a continuation of Ser. No. 92,508, Jul. 16, 1993, abandoned, which is a continuation-in-part of Ser. No. 926,905, Aug. 7, 1992, abandoned.

[51] Int. Cl.[6] ..... H01Q 1/00

[52] U.S. Cl. ..... 343/722; 343/715; 343/858; 343/895

[58] Field of Search ..... 343/722, 749, 343/750, 715, 858, 900, 895; H01Q 1/00, 1/36, 9/00

[56] References Cited

U.S. PATENT DOCUMENTS

| | | | |
|---|---|---|---|
| 3,725,942 | 4/1973 | Ukmar | 343/715 |
| 4,085,405 | 4/1978 | Barlow | 343/858 |
| 4,095,229 | 6/1978 | Elliott | 343/715 |
| 4,097,867 | 6/1978 | Eroncig | 343/715 |
| 4,106,025 | 8/1978 | Katz | 343/715 |
| 4,117,493 | 9/1978 | Altmayer | 343/750 |
| 4,141,016 | 2/1979 | Nelson | 343/858 |
| 4,157,547 | 6/1979 | Freimark et al. | 343/858 |
| 4,222,053 | 9/1980 | Newcomb | 343/722 |
| 4,229,743 | 10/1980 | Vo et al. | 343/749 |
| 4,404,564 | 9/1983 | Wilson | 343/750 |
| 4,940,989 | 7/1990 | Austin | 343/749 |
| 5,057,849 | 10/1991 | Dorrie et al. | 343/722 |
| 5,089,829 | 2/1992 | Haruyama et al. | 343/852 |
| 5,258,765 | 11/1993 | Dorrie et al. | 343/722 |
| 5,451,967 | 9/1995 | Ueda et al. | 343/722 |

*Primary Examiner*—Michael C. Wimer
*Attorney, Agent, or Firm*—Varnum, Riddering, Schmidt & Howlett LLP

[57] ABSTRACT

An AM/FM/CB/cellular telephone antenna includes a first frequency self-resonant circuit at a position above the lower end of the antenna such that the electrical length of the lower section of the antenna is equivalent to one-quarter wavelength for a frequency in the FM frequency range and a second frequency self-resonant circuit disposed below the first frequency self-resonant circuit. The first self-resonant circuit presents a high impedance in the FM frequency band and the second self-resonant circuit presents a high impedance in the cellular frequency range. The entire length of the antenna is equivalent to one-quarter wavelength in a frequency in the CB frequency band. The antenna wire is wound around a fiberglass core, and the FM self-resonant circuit is formed by a tightly wound, coiled section of the wire together with a thin-walled brass tube extending over the core in the area of the tightly wound section. A thin dielectric film is applied between the tube and the tightly wound section of antenna wire thereby forming a capacitor. There is no direct electrical connection between the antenna wire and the tube, and the capacitance between these elements is essentially only stray capacitance. Two antennas, each comprising two frequency self-resonant circuits, are connected by means of a multiplexing circuit to AM/FM, CB and cellular telephone apparatus.

4 Claims, 3 Drawing Sheets

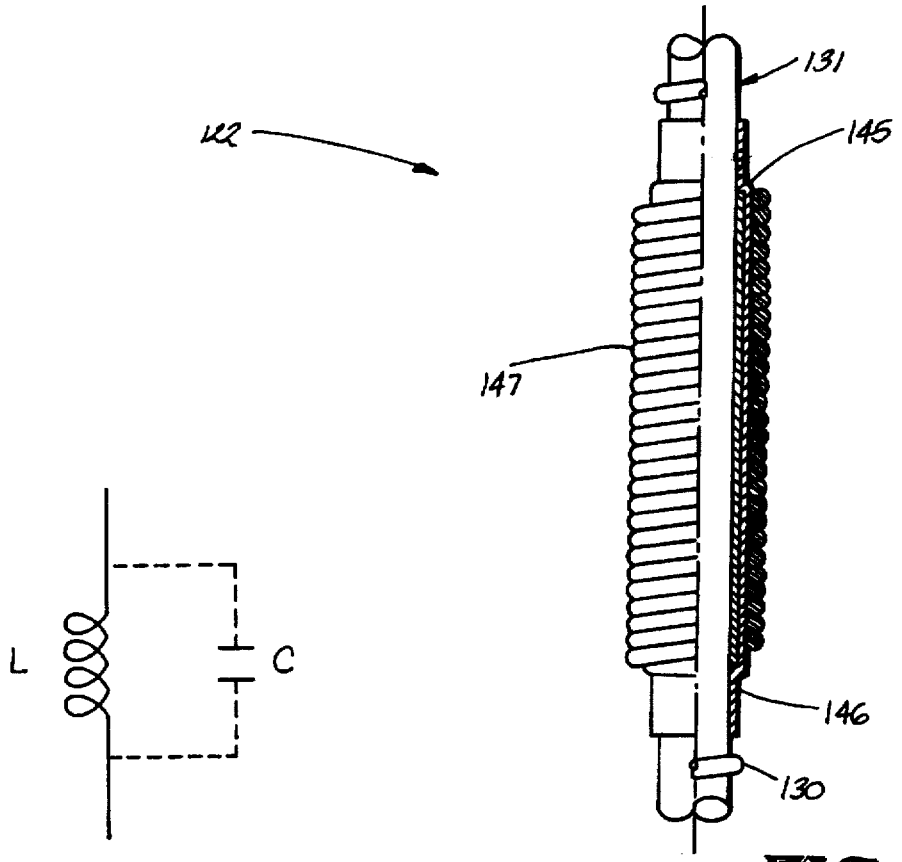
FIG. 3
FIG. 2
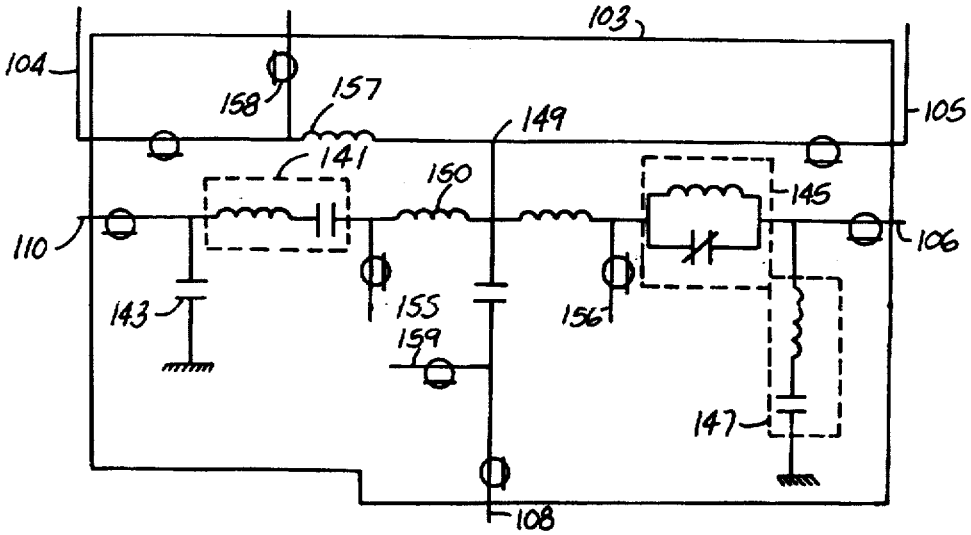
FIG. 5

MULTIBAND ANTENNA SYSTEM

RELATED APPLICATIONS

This is a continuation-in-part of application Ser. No. 08/452,079, filed May 26, 1995, now abandoned, which is a continuation of application Ser. No. 08/092,508, filed Jul. 16, 1993, now abandoned, which is a continuation-in-part of application Ser. No. 07/926,905, filed Aug. 7, 1992, now abandoned.

BACKGROUND OF THE INVENTION

1. Field of the Invention

The invention pertains to antennas and more particularly to multiband antennas for use in the AM/FM/CB and cellular telephone bands.

2. Prior Art

Multiband antennas which simultaneously serve as antennas for AM/FM broadcast radio and for Citizen Band transceivers are known. A problem in designing antennas of this type is to define an antenna which has near optimal receiving/transmission capabilities in several separate frequency bands. The AM radio band falls in the comparatively low frequency range of 550 to 1600 KHz while FM radio operates in the 88 to 108 MHz range and CB operates in the relatively narrow range of 26.95 to 27.405 MHz. Cellular telephone operates in a frequency band of 825 to 890 MHz. It is well known from antenna design principles that a commonly used electrical length for a rod antenna used with a ground plane is one-quarter of the wavelength of the transmitted signal. Thus, there is a design conflict when a single antenna is used for several frequency ranges. One option used in prior art antenna design is to tune the antenna to the separate frequencies when switching between bands. This has obvious disadvantages to the user of the radio, using impedance matching networks. Another option is to design an antenna which provides a compromise and is usable in several frequency bands. Such an antenna, by its nature, provides near optimal reception in at most one frequency range. For example, it is not uncommon in automobile antennas to use an antenna length equivalent to one-quarter wavelength to the midpoint of the FM range. As a consequence, the lower frequency AM reception is not optimum but is acceptable. However, such an antenna is unacceptable for use with a cellular or CB transceiver. Similarly, a CB antenna does not provide adequate FM or cellular reception.

In automobiles and trucks, it is common to use one antenna for CB and another for AM/FM and a third for cellular telephone. Trucks typically use a pair of CB antennas connected in parallel and through a T-connection to the CB radio equipment. The antennas are often mounted on the side view mirrors on both sides of the cab which, because of their location outside of the cab and beyond the sides of the trailer or box behind the cab, provide a favorable signal reception position. It is not feasible, however, to put separate AM/FM, cellular and CB antennas on the mirrors because of space and interference considerations. Consequently, these antennas have typically been placed in various locations on the vehicle with less than satisfactory signal reception or transmission. For example, reception or transmission for FM and cellular telephone antennas mounted on the roof of a truck cab is often blocked by the box of the truck.

A significant problem in multiple antenna systems of the prior art is the mismatch in electrical characteristics between the two separate antennas of a dual antenna system and the mismatch between the antennas and the radio equipment. Such mismatches result in a loss of power and can cause damage to the radio equipment due to reflected energy. The loss of power is particularly noticeable in fiberglass cabs which lack the standard ground plane.

U.S. Pat. No. 4,229,743 to Vo et at., issued Oct. 21, 1980, discloses a multiband AM/FM/CB antenna having a plurality of resonant frequencies. This prior art antenna uses coil sections wound around portions of the antenna to form a network. The network is used to provide an impedance element having a resonant frequency at approximately 59 MHz. This is an approximate midpoint between the CB and FM band and does not provide optimal reception in the two separate bands.

U.S. Pat. No. 5,057,849 to Dörrie et al. issued Oct. 15, 1991, discloses a rod antenna for multiband television reception. That antenna uses a support rod with two connected windings wound on the rod, one of the windings being spiraled with wide turns and the other being tightly wound. The two windings are capacitively coupled to the antenna connection element by a loop of a third winding. This antenna, when connected to a television receiver, allows the receiver to be switched between UHF and VHF without requiring specific tuning of the antenna. The antenna, however, does not provide optimal reception of two separate frequency bands.

Frequency self-resonant circuits have been used by amateur radio operators to be able to use the same antenna for more than one frequency band. Such known frequency self-resonant circuits customarily consist of a coil in the antenna with a discrete capacitor connected across the coil and external to the coil. Together, the coil and capacitor form an LC circuit which presents a high impedance at a selected frequency to effectively isolate a portion of the antenna at the selected frequency. Such an arrangement with discrete capacitors is not practical for automotive antennas and other applications.

U.S. Pat. No. 4,404,564 to Wilson, issued Sep. 13, 1983, discloses an omni-directional antenna in which the electrically conductive antenna element is wound around a rod of insulating material and a tuning device comprising a hollow cylinder of non-conductive material mounted on the antenna rod and a metallic sleeve around a portion of the cylinder and an outer coil electrically isolated from the sleeve and the antenna conductor. Such an arrangement does not provide the desired frequency band separation.

U.S. Pat. No. 4,22,053 to Newcomb discloses an amateur radio antenna constructed of a plurality of telescoping, overlapping tubular sections. The antenna includes a self-resonant circuit comprising a coiled wire section having opposite ends electrically connected to two different telescoping tubular sections which are electrically insulated from each other. The self-resonant circuit has an inductive component provided by the wire coil and a capacitive component provided by the overlapping tubular sections, with the overlapping tubular sections essentially acting as plates of a capacitor. Such overlapping tubular section antennas work well as stationary antennas but are not acceptable for motor vehicle antennas, particularly where relatively long antennas are required, such as for CB transmission and reception. A problem with such prior art multiband antennas is that the antennas are bulky, have too much wind resistance for use on motor vehicles and are not aesthetically pleasing.

Antennas which serve both for cellular telephone and CB are not generally known among commercially available antennas. The difference in operating frequency between the cellular telephone and CB radio is sufficiently great that the designer of a cellular telephone antenna faces an entirely different set of problems than the designer of a CB antenna. The CB antenna operates in a range where a quarter wavelength is approximately 9 feet while the cellular antenna must operate in a frequency range where a quarter wavelength is approximately 3.3 inches. CB antennas are commonly used on trucks and mounted on side mirrors which are spaced apart by approximately 9 feet, or one-quarter wavelength and the CB range to provide and enhance that radiation pattern. Combining a cellular antenna with a CB antenna at that spacing is more likely to result in a signal cancellation than in signal enhancement. However, a need for a single antenna structure which would serve as an AM/FM/CB/cellular radio antenna has existed for some time. It is recognized that the manufacturer of a single antenna structure is more cost effective both in manufacturer and installation and maintenance on the vehicle than a plurality of antennas. Placement and mounting of plurality of antennas requiring the drilling holes and separate wiring adds to the expense and inconvenience of a proliferation of antennas on a vehicle.

SUMMARY OF THE INVENTION

These and other problems of the prior art are overcome in accordance with this invention by means of a single, continuous antenna wire formed with a plurality of spaced apart coils defining several antennas and effective in various frequency ranges, including the CB and cellular radio frequency range.

An antenna, in accordance with the present invention, comprises an antenna wire and a self-resonant inductor constructed of a plurality of turns of the antenna wire formed into a coiled section. A conductive sleeve is disposed internal to the coiled section and a layer of dielectric material disposed between the conductive material and the coiled antenna wire. In that configuration the metal sleeve serves to reduce the self-resonance Of the inductor and helps to control the resonant frequency. The coiled section and the conductive sleeve form a circuit in which only parasitic currents flow. Only a single conductive sleeve is required for the self-resonant circuit and separate electrical connections to the sleeve or the coiled section are not required.

In accordance with one aspect of the invention, an AM/FM/CB/cellular antenna is formed from a solid core wire continuously extending between a terminating end of the antenna, which is connectable to a transmitter/receiver, and a distal end opposite the terminating end. An FM resonant circuit section, disposed one-quarter wavelength in the FM frequency range from a lower end of the antenna, comprises a portion of the antenna wire formed into a multiple-turn coiled section with successive turns disposed immediately adjacent one another and a layer of conductive material disposed internal to the coiled section and spaced apart from the coiled section by a layer of dielectric material. The adjacent turns of the coiled section together act as a plate of a capacitor and the sleeve forms another plate of the capacitor. The self-resonant inductor provides a high impedance in the FM frequency range. The impedance has an inductive component provided by successive turns of the coiled section and a capacitive component provided by stray capacitance between the layer of the conductive material and the successive turns of the coiled section. A cellular resonant circuit section, disposed three-quarter wavelength in the cellular frequency range from the lower end of the antenna, provides high impedance to signals in the cellular telephone frequency range, thereby defining a cellular telephone antenna in the lower portion of the antenna. A further coiled section, forming a phase inversion coil, is disposed one-quarter wavelength in the cellular frequency range from the lower end of the antenna. The full length of the antenna is available as a CB and AM antenna.

The antenna wire is preferably wound around a solid, non-conductive core with successive turns of the wire being spaced apart in the areas above and below the resonant sections and wound immediately adjacent each other in the resonant circuit sections.

In one particular embodiment of the invention, the conductive sleeve, in the form of a cylindrical tube, extends over a section of the core and the dielectric material extends over the tube such that the tightly wound coiled section is wound around the section of the core occupied by the sleeve and is separated from the sleeve by the dielectric material. The metal sleeve acts to reduce the self-resonance of the inductor and helps to control the resonant frequency at a predetermined value.

Advantageously, the self-resonant circuit in accordance with this invention is easy to manufacture. The wire may be wound around a nonconductive core of fiberglass or other like material. The conductive sleeve and the layer of dielectric material are positioned in the core prior to winding the wire around the core. The wire is continuously wound around the core at various numbers of turns per unit length over the length of the core.

Advantageously, the self-resonant circuit in accordance with the invention does not require any screws or other fasteners which extend into the core and introduce stress points in the fiberglass core.

One embodiment of the invention, a multiband radio antenna system comprises a pair of spaced apart rod antennas each comprising a conductive antenna wire including self-resonant circuit at the cellular telephone frequency and a self-resonant circuit at the FM frequency. Each self-resonant circuit is comprised of a coiled section with the FM section having a layer of conductive material disposed internal to the coiled section and a layer of dielectric material disposed between the layer of conductive material and the antenna wire. A multiplexer circuit is provided to couple the pair of antennas to cellular telephone equipment, an AM/FM radio and a CB radio. In one specific embodiment of the invention, the antennas have an overall electrical length equivalent to a quarter wavelength within the CB range and the FM and cellular resonant sections in each antenna are positioned at an electrical distance from one end of the antenna equivalent to a quarter wavelength for a frequency falling in the FM frequency range and three-quarter wavelength in the cellular telephone range, respectively.

The two spaced apart antennas preferably each have windings in the corresponding sections of the two antennas which are substantially identical in angular dimension and in spacing. Advantageously, such substantially identically wound sections provide substantially identical matching electrical characteristics for the two antennas, thereby significantly increasing the gain of the two-antenna system over mismatched antennas.

In one embodiment of the invention, a pair of the antennas is electrically connected to a CB transceiver, a cellular telephone transceiver and an AM/FM radio through a multiplexer circuit. In one particular embodiment of the invention, the multiplexer is further provided with isolation circuitry operative in the cellular frequency band to isolate one of the pair of antennas from cellular frequency signals from the other antenna. The isolation circuitry may be used to overcome interference negatively affecting the signal pattern, which may occur at cellular telephone frequencies when the two antennas are spaced apart by certain distances.

BRIEF DESCRIPTION OF THE DRAWING

An illustrative embodiment of the invention is described below with reference to the drawing in which:

FIG. 2 is a partially cutaway view of a self-resonant circuit in accordance with the invention;

FIG. 3 is an equivalent circuit representation of the self-resonant circuit of FIG. 2;

FIG. 5 is a circuit diagram of the multiplexer of FIG. 1.

DETAILED DESCRIPTION

Figure 1:
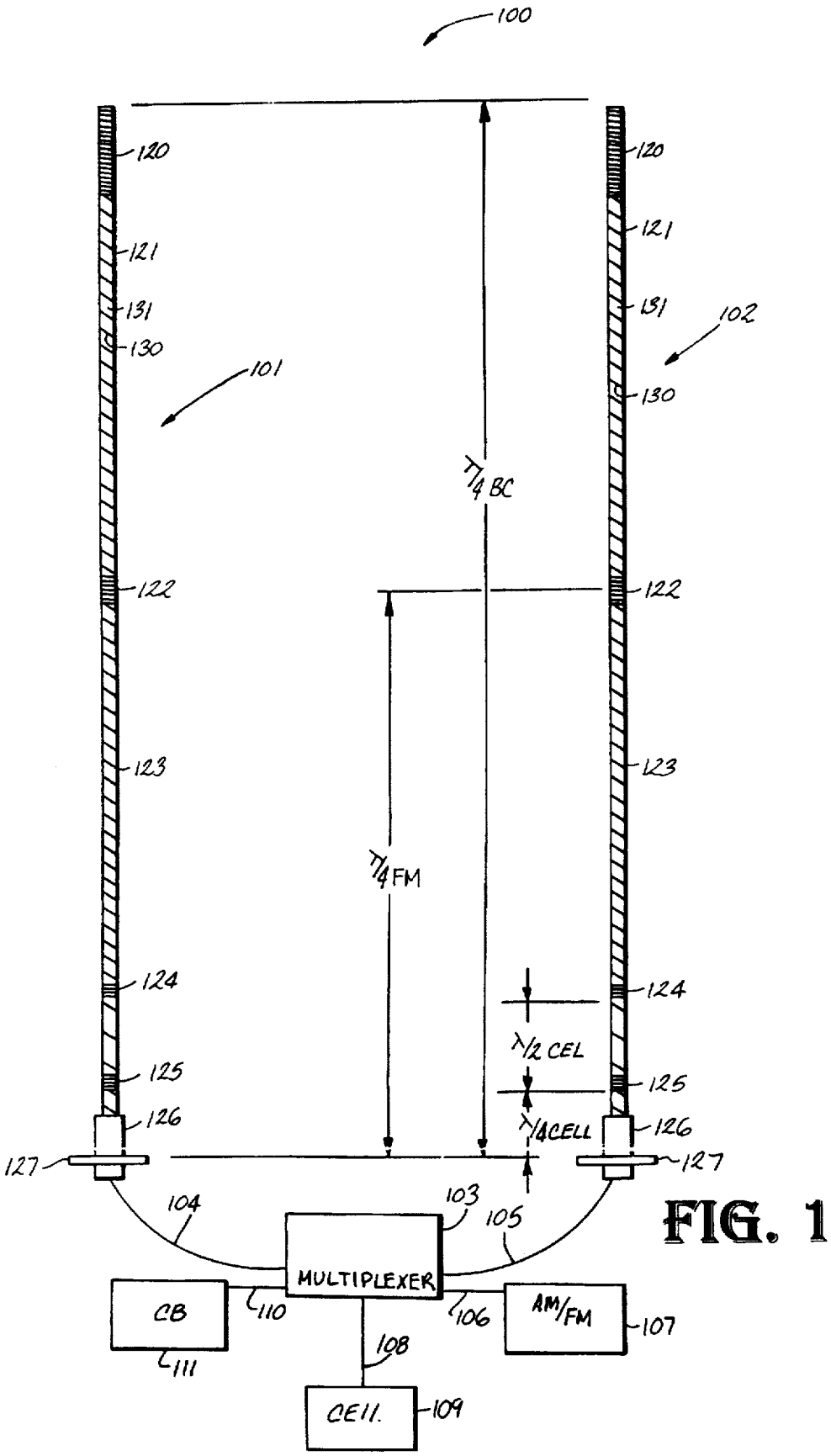
FIG. 1 is a diagrammatic representation of a dual CB/AM-FM/cellular telephone antenna system incorporating the principles of the invention.

FIG. 1 shows an antenna system 100 comprising a pair of identical antennas 101, 102. The antennas 101, 102 are connected to a multiplexer 103 via conductors 104, 105, respectively. The multiplexer 103 serves to connect the antennas to an AM/FM receiver 107 via conductor 106, to cellular telephone equipment 109 via conductor 108 and to a CB transceiver 111 via conductor 110. Each of the antennas is mounted by means of a mounting nut 126 on a bracket 127 which may, for example, be a side mirror mounting bracket of a truck. The overall antenna is preferably on the order of 54 inches in length. The antennas each comprise an enamel coated conductive antenna wire 130 wound around an essentially cylindrically shaped core 131. The core 131 may be a solid core of fiberglass or the like material having a diameter of ¼ inch. The wire of each antenna extend continually from the top of the core 131 to the mounting nut 126 where each antenna is connected to multiplexer 103 via one of the conductors 104, 105. The wire section from the mounting nut 126 to the upper end of the rod 131 has an electrical length of one-quarter wavelength in the CB frequency range. Similarly, antennas are described in application Ser. No. 08/452,079, filed May 26, 1995, entitled "Multiband Antenna System" which is incorporated by reference herein.

The overall length of the wire 130 includes a tightly wound loading coil 120 at the top of each antenna as well as the wire section 121 extending between the loading coil 120 and an FM self-resonant circuit 122. In the FM self-resonant circuit the successive turns of the wire 130 are immediately adjacent each other. The successive turns of the wire 130 are spaced apart in the area 123 between the FM self-resonant circuit 122 and a cellular self-resonant circuit 124. In the cellular self-resonant circuit 124, as in the FM self-resonant circuit 122, the successive turns of the wire 130 are disposed immediately adjacent each other. The electrical length of the wire section from the mounting nut 126 to the lower end of the FM self-resonant circuit 122 has an electrical length of one-quarter wavelength in the FM frequency range. The wire section between the cellular self-resonant circuit 124 and the mounting nut 126 has an electrical length of three-quarter wavelength in the cellular frequency range. Since the cellular antenna is so short physically compared with either the FM or CB quarter-wave antenna, a phase reversing coil 125 is placed a quarter-wave above the feed and a half-wave below the cellular frequency self-resonant circuit. This allows the current between the phase reversing coil and cellular frequency self-resonant circuit to be in phase with the current on the quarter-wave radiating element between the phase reversal coil and feed point, thus enhancing the antenna gain at cellular frequencies. A phase inverter coil 125 is disposed in the cellular section of the antenna and serves to provide phase inversion, as is common in cellular telephone antennas.

FIG. 2 shows the FM self-resonant circuit 122 in partial cut away. Shown in FIG. 2 is a section of the fiberglass core 131 around which the antenna wire 130 is wound. In the area of the FM self-resonant circuit the antenna wire is wound to form a coiled section 147 with the successive turns of the coil immediately adjacent one another. A thin walled brass tube 145 is extended over the core 131 with its horizontal centerline at the electrical length from the lower end of the antenna equivalent to one-quarter wavelength in the FM frequency range, at approximately 100 MHz. A thin dielectric film 146 is applied over the exterior surface of the tube 145 and the antenna wire 130 is tightly wound over the dielectric film.

FIG. 3 shows an equivalent circuit of the FM self-resonant circuit 122 which includes an inductance L introduced by the tightly wound coiled section 147 and a capacitance C resulting from the tube 145 disposed within the coiled section and separated from the coiled section 147 by the dielectric 146. There is no direct electrical connection between the antenna wire 130 and the tube 145 and the capacitance between the antenna wire 130 and the tube 145 is essentially only stray capacitance. For this reason, the connections between the coil L and capacitor C, in FIG. 3, are shown in the form of dotted lines.

An antenna incorporating an FM self-resonant circuit in accordance with the invention may be readily constructed by sliding the metallic tube, having an inner diameter slightly larger than the core, over the core and taping a thin layer of dielectric material over the core prior to coiling the antenna wire on the core. In one particular embodiment of the invention, the brass tube 145 is approximately 2 inches long and has walls which are 0.012 inches thick. The dielectric film in this particular embodiment is a single-layer Kapton® film with a thickness in the range of 0.002 to 0.004 inches. The antenna wire 130 may be a 20-gauge, enamel-coated wire or the like which is tightly wound to form the coiled section 147 with on the order of 35 to 40 turns over the 2 inch length of the tube 145. This arrangement has been found to be self resonating at approximately 100 MHz. The dimensions of the tube and dielectric and the antenna wire as well as the number of turns in the coiled section 147 clearly can be varied and adjusted by one skilled in the art to obtain the resonance at the desired frequency and the above-noted dimensions are provided only as an exemplary embodiment.

Figure 4:
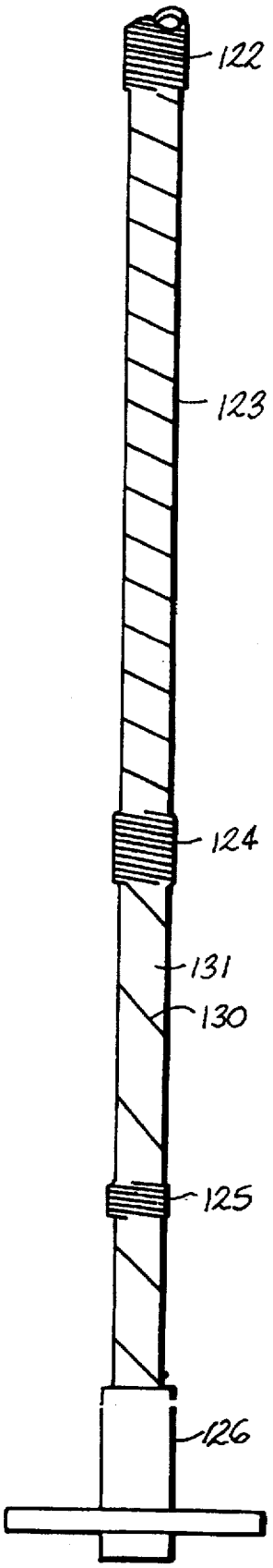
FIG. 4 is an enlarged breakaway view of the cellular telephone portion of one of the antennas of FIG. 1.

FIG. 4 is an enlarged view of the lower section of one of the antennas 101, 102 showing the portion of the antennas below the FM self-resonant circuit 122. Successive turns of the wire 130 below the FM self-resonant circuit 122 is wound around core 131 with approximately three inches per revolution and above the FM self-resonant circuit 130 is wound around the core 131 with approximately 1 to 1.5 inches per revolution. The cellular self-resonant circuit 124 consists of three to five turns of the enamel coated wire 130 with successive turns of the wire disposed immediately adjacent one another and wound on the core 131 without the use of a tubular section and dielectric such employed in the FM self-resonant circuit 122, as shown in FIG. 2. The adjacent turns of the wire 130 in the cellular self-resonant circuit 124 provide sufficient stray capacitance at the cellular frequencies to form an LC circuit which resonates at cellular frequencies. In this manner, the upper portion of the antenna above the cellular self-resonant circuit is isolated from the cellular part of the antenna. Further provided in the cellular section of the antenna is a phase inversion coil 125 consisting of approximately six to eight turns of the wire 130 with adjacent turns of the wire spaced apart by a distance approximately equal to two times the diameter of the wire. The coil 125 performs the same function as a standard phase inversion coil typically employed in a cellular telephone antenna.

To obtain sufficient length for the cellular antenna for appropriate signal reception, the wire 130 in the cellular area could be essentially a straight wire. However, to facilitate manufacturer of the combined cellular AM/FM/CB/cellular antenna, the wire 130 is wound around the core 131 in the cellular area with adjacent windings spaced apart by a convenient distance. In the manufacturing process, the wire 130 is wound around the core 131 while controlling the number of windings per unit length in the various different sections of the antenna. Allowing the wire in the cellular antenna portion to be wound around the core, allows the antenna to be manufactured by a single wire winding operation while varying the pitch of the wire in the various areas on the core. The overall length of the antenna is typically 54 inches. To provide sufficient electrical length of the antenna wire 130 for a quarter wavelength antenna in the CB frequency range, the wire is wound in a loading coil 120.

FIG. 5 schematically shows the circuit of the multiplexer 103 which provides an interface to the CB transceiver 111 via conductor 110, to AM/FM receiver 107 via conductor 106 and to the cellular equipment 109 via conductor 108. The series LC circuit 141 offers a low impedance to the CB signal and a high impedance to the AM/FM signal so as not to load the AM/FM receiver. The parallel LC circuit 145 provides a high impedance at 27 MHz, thereby isolating the CB transmitter from the AM/FM receiver. A pair of coils 150, 151 connected to node 149, at which the antenna conductors 104, 105 are joined, provide high impedance to signals in the cellular frequency range. In this manner, the cellular frequency signals and AM/FM signals are blocked from the CB transceiver 111 and cellular frequency and CB signals are blocked from the AM/FM receiver 107. A capacitor 153 is connected between the node 149 and conductor 108 connected to the cellular telephone equipment 109. The capacitor 153 provides a high impedance at the CB and AM/FM frequencies and a low impedance at the cellular frequencies which isolates the cellular telephone equipment 109 from CB and AM/FM signals. The inductors 150, 151 are self resonant at approximately 850 MHz to maintain a high impedance for cellular telephone frequency signals so as to isolate the cellular signals from the CB and AM/FM radios. The capacitor 153 blocks the lower frequencies from the cellular telephone and offers a low impedance to cellular telephone frequencies when the capacitor is connected in series with an inductor having an inductance of approximately 10 nanohenrys (approximately ½" of standard connection wire). The series LC circuit 147 serves to shunt any CB signal passing through or bypassing the circuit 145 to ground. The capacitor 143 aides in matching the antenna to the CB transceiver 111. The conductors 104, 105, 106, 108 and 110 are preferably coaxial conductors. Referring again to FIG. 5, a coaxial stub 155 is shown connected between the LC circuit 141 and the cot 150. Similarly coaxial stub 156 is shown connected between the coil 151 and the LC circuit 145. The two open, quarter-wavelength coaxial stubs present a low impedance at the cellular telephone frequencies thereby providing additional isolation, if needed. If required, an inductor 157 may be connected between the conductor 104 and the node 149. The inductor 157 is self resonant at cellular telephone frequencies and provides isolation between the two antennas 101, 102 in the event that the antennas are positioned such that interference of cellular signals in the two antennas tends to occur. To provide additional isolation, an open coaxial stub 158 of a quarter wavelength at a cellular frequency, blocking cellular frequency signals, may be connected to the conductor 104 to provide additional isolation. A shorted coaxial stub having an electrical length of one-quarter wavelength of signals in the cellular frequency range provides a low impedance to AM/FM and CB signals to further isolate the cellular radio apparatus from these signals.

What is claimed is:

1. A multiband radio antenna system for installation on an automotive vehicle comprising:

a pair of spaced apart antennas each comprising a terminating end connectable to transmitter/receiver apparatus and a distal end opposite the terminating end;

each of the antennas further comprising:

a solid core antenna wire extending between the terminating end and the distal end of each antenna and forming an antenna having an overall electrical length equivalent to one-quarter wavelength of a frequency in the CB frequency range;

a first self-resonant circuit section disposed a first predetermined distance from the terminating end such that a portion of the antenna wire between the first self-resonant circuit section and the terminating end forms an antenna having an electrical length equivalent to one-quarter wavelength in the FM frequency range;

a second self-resonant circuit section disposed a second predetermined distance from the terminating end such that a portion of the antenna wire between the second self-resonant circuit section and the terminating end forms an antenna having an electrical length equivalent to three-quarter wavelength in the cellular frequency range;

the first self-resonant circuit section of each antenna comprising, in combination, a portion of antenna wire formed into a multiple-turn coiled section and a layer of conductive material disposed internal to the coiled section and a layer of dielectric material disposed between the layer of conductive material and the multiple-turn coiled section;

the first self-resonant circuit sections each having a signal blocking impedance at a selected frequency defined by an inductive component provided by turns of the respective multiple-turn coiled section in each antenna and a capacitive component provided by stray capacitance between the respective layer of conductive material and turns of the respective multiple-turn coiled section in each antenna;

transmitter/receiver apparatus comprising CB radio apparatus and FM radio apparatus and cellular telephone apparatus and a multiplexer circuit for selectively coupling the pair of antennas to the CB radio apparatus and the FM radio apparatus and the cellular telephone apparatus, the multiplexer circuit comprising an input conductor connected to each of the antennas and a first output conductor for connection to the CB radio apparatus, a second output conductor for connection to the FM radio apparatus and a third output conductor for connection to the cellular radio apparatus, the multiplexer circuit further comprising a series L-C circuit connected between the input conductor and the first output conductor and having a first inductor and a first capacitor connected in series and providing a blocking impedance to signals in the AM/FM frequency range and a second inductor connected in series with the L-C circuit providing a blocking impedance to signals in the cellular frequency range.

2. The antenna system in accordance with claim 1 and further comprising a parallel L-C circuit connected between the input conductor and the second output conductor for blocking signals in the CB frequency range and an additional inductor connected in series with the parallel L-C circuit for blocking signals in the cellular frequency range.

3. The antenna system in accordance with claim 2 and further comprising a capacitor connected between the input conductor and the third output conductor for blocking lower frequency signals in the CB and AM/FM frequency ranges.

4. The antenna system in accordance with claim 1 and further comprising an inductor connected between one of the antennas and the input conductor for blocking signals in the cellular frequency range from one of the two antennas.

* * * * *